United States Patent [19]

Shindou et al.

[11] Patent Number: 4,792,499

[45] Date of Patent: Dec. 20, 1988

[54] ZN-AL HOT-DIP GALVANIZED STEEL SHEET HAVING IMPROVED RESISTANCE AGAINST SECULAR PEELING AND METHOD FOR PRODUCING THE SAME

[75] Inventors: Yoshio Shindou; Motoo Kabeya; Katushi Saito, all of Kimitsu, Japan

[73] Assignee: Nippon Steel Corporation, Tokyo, Japan

[21] Appl. No.: 16,715

[22] Filed: Feb. 19, 1987

[30] Foreign Application Priority Data

Feb. 21, 1986 [JP] Japan ..... 61-34992

[51] Int. Cl.[4] ..... B32B 15/01

[52] U.S. Cl. ..... 428/659; 428/684

[58] Field of Search ..... 428/659, 681, 684, 685

[56] References Cited

U.S. PATENT DOCUMENTS 4,056,366 11/1977 Lee et al. ..... 29/653
4,383,006 5/1983 Shindo et al. ..... 428/659

FOREIGN PATENT DOCUMENTS 56-105447 8/1981 Japan .
57-26155 2/1982 Japan .
58-177447 10/1983 Japan .

*Primary Examiner*—R. Dean
*Assistant Examiner*—George Wyszomierski
*Attorney, Agent, or Firm*—Wenderoth, Lind and Ponack

[57] ABSTRACT

A Zn-Al hot dip galvanized steel sheet having an improved resistance to secular peeling of a galvanized layer, characterized by a composition of the layer and galvanizing bath which consist of from more than 0.3 wt % to 10 wt % of Al, from 0.2 to 1.0 wt % of Sb, a total of less than 0.02 wt % of impurities including Pb and Sn, and a balance of Zn.

4 Claims, No Drawings

ZN-AL HOT-DIP GALVANIZED STEEL SHEET HAVING IMPROVED RESISTANCE AGAINST SECULAR PEELING AND METHOD FOR PRODUCING THE SAME

BACKGROUND OF THE INVENTION

1. Field of the Invention

The present invention relates to a hot-dip galvanized steel sheet having a zinc-aluminum alloy galvanized layer (hereinafter referred to as the Zn-Al galvanized steel sheet), and a method for producing the same. More particularly, the present invention relates to a method for preventing an intergranular corrosion of a galvanized layer and propagation of cracks due to intergranular corrosion which occurs when the Zn-Al galvanized steel sheet is stored indoors for a long period of time or in a high temperature- and a high humidity-atmosphere (90° C. or higher and 90% or higher of RH), and for preventing a galvanized layer from peeling from the steel base due to embrittlement of the galvanized layer.

2. Description of the Related Art

Zinc-galvanized steel sheet is the most widely used among surface-treated steel sheets, and demands by users for an enhancement of the qualities of these zinc-galvanized steel sheets grow increasingly stronger. Recently, serious research has been carried out into the development of products, which can meet users demands for enhanced corrosion-resistance, workability, and paintability, produced from sheets galvanized with multi-components, such as Zn-Al.

When a zinc-galvanized steel sheet using an inexpensive base metal of zinc undergoes a secular change when inside a house or is exposed to a high temperature- and high humidity environment, intergranular corrosion occurs. This intergranular corrosion gradually worsens and causes the galvanized layer to become embrittled, and thus to peel away from the steel base. This intergranular corrssion, embrittlement, and peeling of the galvanized layer occurs frequently even in a Zn-Al galvanized layer having an improved corrosion resistance, leading to a serious impairment of the quality of the product.

As an example of an improved resistance against secular peeling, U.S. Pat. No. 4,056,366 discloses a Zn-Al galvanized steel sheet having a galvanized layer characterized by containing from 0.2 to 17 wt % of Al, from 0.02 to 0.15 wt % of Sb, and not more than 0.02 wt % of Pb, the balance being Zn, and a method for producing the same. Further, Japanese Unexamined Patent Publication No. 56-105,447 proposes a zinc alloy for hot dip-galvanizing with an improved intergranular corrosion characterized by a bath composition of from 0.05 to 2.0 wt % of Al, from 0.005 to 1.0 wt % of Mg, and from 0.1 to 1.0 wt % of one or more of Cu and Sb, the balance being Zn and unavoidable impurities. Furthermore, Japanese Unexamined Patent Publication No. 58-177,447 proposes a method for galvanizing a steel sheet by means of a galvanizing bath which consists of from 0.1 to 25 wt % of Al, less than 0.1 wt % of Sb, from 0.05 to 2.0 wt % of Mg, ad not more than 0.01 wt % of Pb, the balance being Zn and unavoidable impurities.

The present inventors proposed, in Japanese Unexamined Patent Publication No. 57-26,155 (Japanese Patent Application No. 55-98,251), a method for producing a zinc galvanized steel sheet with zero spangles, having an improved resistance against secular peeling of a galvanized layer, characterized in that the galvanizing bath consists of from 0.1 to 0.2 wt % of Al, from 0.1 to 0.5 wt % of Sb, and a total of less than 0.02 wt % of the unavoidable impurities, Pb, Cd, Sn, and the like, but excluding Fe, and a balance of Zn.

SUMMARY OF THE INVENTION

The present inventors scrutinized in detail the invention described in Japanese Unexamined Patent Publication No. 57-26,155, upon industrialization thereof, and enhanced hhe feasibility thereof to a continuous hot-dip galvanizing line with a high productivity. This is described more specifically as follows.

(1) When killed steels are to be applied, an abnormal growth of the Fe-Zn galvanized alloy layer, which is brittle in working, is liable to occur at an interface between the steel and a galvanized layer, due to the cleanliness of the surface of the steel sheet. This frequently leads to a failure in the galvanizing adhesion, and thus it became necessary to reconsider the Al content of galvanizing bath.

(2) The Al segregates in the grain boundaries of a galvanized layer, and the segregated Al forms a local cell with Zn during the initial corrosion and behaves as a cathode, resulting in preferential corrosion of the grain boundaries. This is repeated, and the products suffering from intergranular corrosion increase in volume, with the result that corrosion-induced cracks form inside the galvanized layer. Accordingly, to suppress this phenomenon, the Sb content must be reconsidered.

Based on the above described background, a method according to the present invention has been proposed as described hereinafter.

It is an object of the present invention to provide a method for producing a Zn-Al galvanized steel sheet, which, without imparing the function of Al of enhancing the corrosion resistance, completely eliminates, by means of an Sb addition into the pure zinc-galvanizing bath, the greatest drawback of the Zn-Al galvanized steel sheet, i.e., the peeling of a galvanized layer due to secular degradation.

Another object of the present invention is to provide a method for producing a Zn-Al galvanized steel sheet having an improved flatness of appearance and resistance against secular peeling of a galvanized layer, by imparting an appropriate cooling speed to a melted galvanized layer formed by the above-mentioned galvanizing bath, immediately before solidification of the galvanized layer.

A further object of the present invention is to provide a method for producing a Zn-Al galvanized layer in which spangles can be created in a distinguishable manner, so that the method is highly versatile in use in the production line.

DESCRIPTION OF THE PREFERRED EMBODIMENTS

The present inventors discovered that, when from 0.2 to 1.0 wt % of Sb is added to a galvanizing bath consisting of from more than 0.3 wt % to 10 wt % of Al, and less than 0.02 wt % of total of the impurities including Pb and Sn, the balance being Zn, the galvanized alloy layer of Zn and Al has an improved resistance against secular peeling thereof. The present inventors also discovered that, when the cooling speed of a galvanized layer is enhanced as much as possible, in the semimolten state, and immediately before the solidification, an extremely fine spangle appearance is obtained.

Accordingly, the features of the Zn-Al galvanized steel sheet and production method thereof according to the present invention are as follows:

(A) An α-Al, which is active and is enriched in the grain boundaries of a galvanized layer, and in or in the vicinity of an Fe-series alloy layer, is fixed and eutectically crystallized by Sb as Al-Sb, thereby successfully making the active α-Al electrochemically inactive. This leads to the suppression of the intergranular corrosion of the galvanized layer, which is the greatest drawback to a Zn-Al galvanized steel sheet, while retaining the high corrosion resistance of the Zn-Al galvanized steel sheet, and to a complete elimination of both the propagation and enlargement of intergranular corrosion cracks resulting from the advance of the corrosion and the peeling of the embrittled galvanized layer from the steel substrate.

(B) In addition, the function of Sb, such as developing galvanizing spangles under natural cooling, is utilized for creating from coarse to fine spangles in the identical galvanizing bath in a distinguishable manner, while setting a cooling speed in such a manner that it assists a change of size of the spangles. Natural cooling is cooling carried out in still air.

The present invention is hereinafter described with regard to the components of a galvanizing bath and the limiting conditions for the galvanizing method.

(1) Aluminum

As the Al content becomes greater, the corrosion resistance is enhanced, but a preferential corrosion of α-Al, which segregates in the grain boundary of the crystals is liable to occur. When the intergranular corrosion cracks propagate and enlarge, a brittle fracturing of the galvanized layer is incurred, and thus, finally, the galvanized layer peels from the steel substrate. The upper limit of Al in the galvanizing bath is set as 10 wt %, from this viewpoint and from the following viewpoint. Namely, mixed $\theta+\eta$ phases, which are hard and brittle in the Fe-Al series alloys, abnormally grow as a layer at the interface of a steel substrate, with the result that the adhesivity of a galvanized layer is degraded. The upper limit of Al is set as 10 wt %, from the viewpoints of corrosion protection saturation and economy. On the other hand, when the Al content is decreased, a binary Fe-Zn (ζ phase), which is hard and brittle, grows as a layer at the interface of a steel substrate, with the result that not only is the adhesivity of a galvanized layer degraded, but also the corrosion resistance and appearance are frequently detrimentally influenced by a pyrmmid form crystallization of an intermetallic compound (dross), in which Fe dissolved from a steel sheet into a bath forms an eutectic. This affects the commercial value of the product. In addition, when the Al content is small and there is a high concentration of Sb, the flowability of a galvanizing bath is lowered. A certain amount of Al is indispensable, to prevent a degradation of the galvanizing operation and the galvanized appearance. The lower limit of Al is, therefore, set as more than 0.3 wt %, preferably from 0.35 to 10.0 wt %.

(2) Antimony

Sb is used to realize the most important feature according to the present invention. Namely, Sb forms an eutectic with the active Al which segregates in a galvanized layer to form an Al-Sb eutectic, thereby preventing or suppressing the intergranular corrosion and secular peeling of a galvanized layer. Sb is also used to provide the bath with a function of refining, if necessary, the coarse spangles formed on the surface of a steel sheet. If the Sb content is less than 0.2 wt %, its function for enlarging the spangles under a natural cooling in the atmosphere is not satisfactory. If the Sb content is small in the galvanized layer, the drop of the melting point of Zn, due to a segregation of Sb is too small to expect an enlargement of the range of the solidification temperature of Zn. In this case, the growth of Zn crystal nuclei is little promoted by Sb, when the galvanizing is carried out on a high speed production line. It is therefore difficult to obtain uniform and coarse spangles having a good appearance. On the other hand, if the Sb content exceeds 1.0 wt %, the flowability of a galvanizing bath becomes so high that the following consequences are incurred. That is, until a galvanized layer solidifies, a flow pattern is formed, and due to the exothermic reaction generated in the Sb segregation process, heat is recuperated, and the solidifying galvanized layer tends to sag and thus greatly swell or become uneven. This in turn incurs the generation of abrasion flaws and makes it difficult to obtain a uniform surface appearance, i.e., control of surface appearance becomes difficult. Accordingly, the Sb content is preferably in the range of from 0.2 to 0.5 wt %.

(3) Unavoidable impurities

Such unavoidable impurities as Pb, Cd, Sn, or the like, promote the intergranular corrosoon of a galvanized layer, and thus the brittle fracturing of Zn. The unavoidable impurities further promote this phenomenon in the copresence of Al. In addition, these unavoidable impurities are liable to concentrate in the grain boundaries of a galvanized layer or in the vicinity of an Fe-series alloy layer formed at the interface of a steel substrate. In this case, they form a local cell, leading to intergranular corrosion and a degradation of the corrosion resistance of a galvanized layer. The unavoidable impurities are, therefore, desirably excluded as much as possible. If the total content of the unavoidable impurities is 0.02 wt % or more, the above described detrimental effects thereof are promoted, and seriously degrade the commercial value of the product. Accordingly, the range of unavoidable impurities is set as less than 0.02 wt %, preferably 0.01 wt % or less.

(4) Quenching Treatment for Refining the Galvanizing Spangles

According to the galvanizing bath of the presentinvention, the Sb has a function of creating and developing the galvanizing spangles and, therefore, coarse spangles are formed after galvanizing under natural cooling. Nevertheless, fine spangles are preferred to coarse spangles in application, in which a good surface appearance is needed, as when the steel sheet is to be painted. Accordingly, the galvanizing bath must have a function of distinguishing the spangles being formed, depending upon necessity.

Generally speaking, the method for refining the coarse spangles is based on the concept of either enhancing the cooling speed to suppress the growth of crystal nuclei of Zn or forming an intermetallic compound and utilizing its nuclei effect so as not to incur a further crystal growth. The composition of the galvanizing bath according to the present invention allows the employment of a method of refining spangles based on either of the concepts mentioned above. However, in the light of the finished surface-appearance of the refined spangles (luster, color tone, smoothness, and the like), the former quenching method is advisable. In addition, to obtain very refined spangles, it is necessary to enhance the cooling speed. General methods for enhancing the cooling speed are a wet method in which a liquid agent having a high latent heat of decomposition is blown onto a zinc-galvanized layer in a semimolten state while reducing the mist diameter as much as possible and enhancing the spray density, and a dry method of blowing metal powder. Any of these methods can be used in the present invention. If the cooling speed is less than 50° C./sec, the coarse spangles are not satisfactorily refined even when seen with the naked eye. In this case, the commercial value is not satisfactory. If the cooling speed is 50° C./sec or more the coarse spangles can be considered satisfactorily refined, even when observed with the naked eye or a microscope. The effect of refining coarse spangles saturates at a cooling speed of more than 300° C./sec. If the cooling speed exceeds value, excessive plant investment becomes necessary and the working environment is degraded. A preferred cooling speed is from 100° to 250° C./sec.

EXAMPLES

The present invention is further described by way of examples.

An unannealed aluminum-killed steel sheet having a thickness of 0.3 mm and a width of 1200 mm was produced by continuous casting and rolling, and was then annealed by a prescribed heating cycle and galvanized under the conditions given in Table 1 in a Sendzimir type hot dip galvanizing line. The galvanized layer in a semimolten state was solidified by allowing to cool in the atmosphere in one case, and in another case, by quenching, thereby producing, in a distinguishable manner, Zn-Al hot dip galvanized sheets having a coarse or fine spangled appearance. The Zn-Al hot dip galvanized steel sheets according to the present invention produced in a distinguishable manner as described above, and comparative steel sheets, were subjected to a test of their resistance against secuar peeling of the galvanized layer, and of other properties. Examples Nos. 1 through 15 are according to the present invention, and examples Nos. 16 through 23 are comparative.

With regard to Zn-Al hot dip galvanized steel sheets with fine spangles. Examples Nos. 1 through 9 according to the present invention illustrate the effectiveness of Sb, while varying the concentrations of Sb and Al in the galvanizing bath. For comparison, Comparative Examples Nos. 16 through 19 are illustrated.

Example No. 15 according to the present invention illustrates the effectiveness of Sb on the coarsening of spangles under natural cooling. For comparison, Comparative Example No. 23 is illustrated. In addition, Examples Nos. 5 and 10 through 14 illustrate the effectiveness of the cooling speed on the refining of the spangles. For comparison, Comparative Examples Nos. 20 and 21 are illustrated. Furthermore, the influence of unavoidable impurities is illustrated in Example 5 and Comparative Example 22.

TABLE 1

| Designation No. | Bath Components (wt %) *1 Al | Sb | Pb | Zn | Cooling Speed After Coating °C./sec *2 | Coating Deposition Amount (g/m²) Per one side *3 | Properties of Coating: Surface Appearance *4 | Resistance Against Secular Peeling of Coating *6 | Corrosion Resistance of Uncoated Sheet *8 | Initial Adhesivity of Coating *7 | Sangle Appearance of Coating *5 |
|---|---|---|---|---|---|---|---|---|---|---|---|
| Example 1 | 0.3 | 0.2 | 0.015 | balance | 200 | 150 | ◎ | ◎ | ○ | ◎ | ○ |
| Example 2 | 0.3 | 0.5 | 0.015 | " | 200 | 150 | ◎ | ◎ | ○ | ◎ | ○ |
| Example 3 | 0.3 | 1.0 | 0.015 | " | 200 | 150 | ◎ | ◎ | ○ | ◎ | ○ |
| Example 4 | 4.5 | 0.2 | 0.015 | " | 200 | 150 | ◎ | ◎ | ◎ | ◎ | ○ |
| Example 5 | 4.5 | 0.5 | 0.015 | " | 200 | 150 | ◎ | ◎ | ◎ | ◎ | ○ |
| Example 6 | 4.5 | 1.0 | 0.015 | " | 200 | 150 | ◎ | ◎ | ◎ | ◎ | ○ |
| Example 7 | 10.0 | 0.2 | 0.015 | " | 200 | 150 | ◎ | ◎ | ◎ | ◎ | ○ |
| Example 8 | 10.0 | 0.5 | 0.015 | " | 200 | 150 | ◎ | ◎ | ◎ | ◎ | ○ |
| Example 9 | 10.0 | 1.0 | 0.015 | " | 200 | 150 | ◎ | ◎ | ◎ | ◎ | ○ |
| Example 10 | 4.5 | 0.5 | 0.015 | " | 300 | 150 | ◎ | ◎ | ◎ | ◎ | ○ |
| Example 11 | 4.5 | 0.5 | 0.015 | " | 250 | 150 | ◎ | ◎ | ◎ | ◎ | ○ |
| Example 12 | 4.5 | 0.5 | 0.015 | " | 150 | 150 | ◎ | ◎ | ◎ | ◎ | ○ |
| Example 13 | 4.5 | 0.5 | 0.015 | " | 100 | 150 | ◎ | ◎ | ◎ | ◎ | ○ |
| Example 14 | 4.5 | 0.5 | 0.015 | " | 50 | 150 | ◎ | ◎ | ◎ | ◎ | ○ |
| Example 15 | 4.5 | 0.5 | 0.015 | " | Natural Cooling | 150 | ◎ | ◎ | ◎ | ◎ | ○ |
| Comparative Example 16 | 0.2 | 0.2 | 0.015 | balance | 200 | 150 | ◎ | ◎ | ○ | x~Δ | x |
| Comparative Example 17 | 12.0 | 0.2 | 0.015 | " | 200 | 150 | Δ | ◎ | ◎ | ◎ | ○ |
| Comparative Example 18 | 0.2 | 1.0 | 0.015 | " | 200 | 150 | Δ | ◎ | ○ | x~Δ | ○ |
| Comparative Example 19 | 12.0 | 1.0 | 0.015 | " | 200 | 150 | Δ~○ | ◎ | ◎ | ◎ | ○ |
| Comparative Example 20 | 4.5 | 0.5 | 0.015 | " | 40 | 150 | ◎ | ◎ | ◎ | ◎ | x |
| Comparative Example 21 | 4.5 | 0.5 | 0.015 | " | 350 | 150 | Δ~○ | ◎ | ◎ | ◎ | ○ |
| Comparative Example 22 | 4.5 | 0.5 | 0.023 | " | 200 | 150 | ◎ | x | ◎ | ◎ | ○ |
| Comparative Example 23 | 4.5 | 0.1 | 0.015 | " | Natural Cooling | 150 | Δ~○ | x | ◎ | ◎ | x |

*1 According to atomic absorption spectroscopy Pb represents the unavoidable impurities.
*2 1 wt % solution of sodium phosphate. A supersonic nozzle was used. Air pressure from 0.1 to 1 kg/cm² and liquid pressure 1 kg/cm².

TABLE 1-continued

| Designation No. | Bath Components (wt %) *1 Al | Sb | Pb | Zn | Cooling Speed After Coating °C./sec *2 | Coating Deposition Amount (g/m²) Per one side *3 | Properties of Coating: Surface Appearance *4 | Resistance Against Secular Peeling of Coating *6 | Corrosion Resistance of Uncoated Sheet *8 | Initial Adhesivity of Coating *7 | Sangle Appearance of Coating *5 |
|---|---|---|---|---|---|---|---|---|---|---|---|

*3 Weight method (according to JISH-0401)
*4 Method for judging surface appearance (observation by naked eye)
◎smooth metallic lustre o slightly uneven
Δ satin finish or pitting
x sagging of plating or unevenness
*5 Method for judging brazing spangles
◦normal galvanizing spangles
x mixing of fine and coarse spangles
*6 Resistance against secular peeling of galvanized layer
After testing in high temperature, wet box (80° C. RH > 95%, 14 days), OT bending test was carried out, and subsequently, bent part peeled by an adhesive test Cellotape - (trade name).
◎no abnormalities
◦only slight peeling
Δ inter-layer peeling
x peeling over the entire surface
*7 Initial adhesivity of galvanizing A ¾ inch punch 5 kg in weight was dropped from a height of 70 cm. The convex part was applied with a tape which was then peeled off.
◎no abnormalities
◦minute peeling
Δ partial peeling
x peeling over the entire surface
*8 Corrosion resistance of nonpainted sheets The sheets were subjected to a chromate treatment with a total chromium deposition amount of 15 mg/m² (per one side) and were then subjected to an exposure test for 24 months in a coastal industrial region. An evaluation by weight loss due to rust generation was then carried out.
◎less than 10% of initial deposition amount of galvanizing
◦less than 30% of initial deposition amount of galvanizing
Δ less than 50% of initial deposition amount of galvanizing
x 50% or more of initial deposition amount of galvanizing

We claim:

1. A Zn-Al hot dip galvanized steel sheet having an improved resistance against secular peeling of a galvanized layer, wherein said steel sheet has a galvanized layer consisting of from more than 0.3 wt % to 10 wt % of Al, from 0.2 wt % to 1.0 wt % of Sb, a total of less than 0.02 wt % of impurities including Pb and Sn, and the balance being Zn and wherein the Al segregates in said galvanized layer and forms an eutectic with the Sb, thereby rendering said galvanized layer resistant to intergranular corrosion and to secular peeling.

2. The Zn-Al hot dip galvanized steel sheet according to claim 1, wherein the Al content is from 0.35 to 10.0 wt %.

3. The Zn-Al hot dip galvanized steel sheet according to claim 1, wherein the Sb content is from 0.2 to 0.5%.

4. The Zn-Al hot dip galvanized steel sheet according to claim 1, 2, or 3, wherein said steel sheet consists of a killed steel.

* * * * *